US010993539B2

(12) United States Patent
He et al.

(10) Patent No.: US 10,993,539 B2
(45) Date of Patent: May 4, 2021

(54) HEAD AND WAIST INTEGRATED DEVICE

(71) Applicant: OKIN REFINED ELECTRIC TECHNOLOGY CO., LTD, Zhejiang (CN)

(72) Inventors: Pengfei He, Zhejiang (CN); Kangming Tao, Zhejiang (CN); Long Li, Zhejiang (CN)

(73) Assignee: OKIN REFINED ELECTRIC TECHNOLOGY CO., LTD, Zhejiang (CN)

( * ) Notice: Subject to any disclaimer, the term of this patent is extended or adjusted under 35 U.S.C. 154(b) by 0 days.

(21) Appl. No.: 16/574,096

(22) Filed: Sep. 18, 2019

(65) Prior Publication Data

US 2020/0100593 A1 Apr. 2, 2020

(30) Foreign Application Priority Data

Sep. 29, 2018 (CN) ..... 201821603718.X
May 24, 2019 (CN) ..... 201920759334.5

(51) Int. Cl.
*A47C 7/38* (2006.01)

(52) U.S. Cl.
CPC ..... *A47C 7/38* (2013.01)

(58) Field of Classification Search
CPC ..... A47C 7/38
See application file for complete search history.

(56) References Cited

U.S. PATENT DOCUMENTS

| | | | | |
|---|---|---|---|---|
| 9,730,522 | B2 * | 8/2017 | Donovan | A47C 7/38 |
| 10,653,245 | B2 * | 5/2020 | Zhang | A47C 7/38 |
| 10,736,426 | B2 * | 8/2020 | Fei | A47C 7/38 |
| 2018/0125247 | A1 * | 5/2018 | Li | A47C 7/38 |
| 2018/0235371 | A1 * | 8/2018 | Chen | A47C 7/46 |

* cited by examiner

*Primary Examiner* — Anthony D Barfield
(74) *Attorney, Agent, or Firm* — JCIP Global Inc.

(57) ABSTRACT

A head and waist integrated device includes a bracket body. The bracket body is provided with a headrest flipping mechanism and a waist ejecting mechanism. The waist ejecting mechanism includes a fixing base fixedly connected to the bracket body, a first driver rotatably connected to one end of the fixing base, a folding link assembly respectively rotatably connected to the first driver and the fixing base, and a waist ejecting member rotatably connected to the folding link assembly. The folding link assembly has a plurality of links disposed therein, crossing and rotatably connected to each other.

12 Claims, 2 Drawing Sheets

HEAD AND WAIST INTEGRATED DEVICE

CROSS-REFERENCE TO RELATED APPLICATION

This application claims the priority benefit of China application serial no. 201821603718.X, filed on Sep. 29, 2018 and China application serial no. 201920759334.5, filed on May 24, 2019. The entirety of each of the above-mentioned patent applications is hereby incorporated by reference herein and made a part of this specification.

BACKGROUND

Technical Field

The present invention belongs to the technical field of sofa, in particular, relates to a head and waist integrated device.

Description of Related Art

A sofa is a very common household item. A regular sofa is fixed, and a shape of the sofa cannot be adjusted according to postures of a user. There are also some electric sofas on the market, and such electric sofas have functions of adjusting the back and lifting a seat cushion to improve the user's comfort. However, traditional sofas generally do not have functions of ejecting out the waistrest and adjusting the headrest.

SUMMARY

In order to make up for the deficiencies of the prior art, the present invention provides a technical solution of a head and waist integrated device.

The head and waist integrated device includes a bracket body. The bracket body is provided with a headrest flipping mechanism and a waist ejecting mechanism. The waist ejecting mechanism includes a fixing base fixedly connected to the bracket body, a first driver rotatably connected to one end of the fixing base, a folding link assembly respectively rotatably connected to the first driver and the fixing base, and a waist ejecting member rotatably connected to the folding link assembly. The folding link assembly has a plurality of links disposed therein. The links cross and are rotatably connected to each other.

In an embodiment of the invention, the folding link assembly includes a first link and a second link. The first link has one end rotatably connected to the first driver, and the other end rotatably connected to the waist ejecting member. The second link has one end rotatably connected to the fixing base, and the other end rotatably connected to the waist ejecting member. A middle portion of the first link is rotatably connected to a middle portion of the second link.

In an embodiment of the invention, a sliding slot is defined in the fixing base, and the end of the first link that is rotatably connected to the first driver is slidably connected to the sliding slot.

In an embodiment of the invention, the first driver is an electric push rod.

In an embodiment of the invention, the waist ejecting member is an L-shaped plate structure.

In an embodiment of the invention, the headrest flipping mechanism includes a second driver rotatably connected to the bracket body, and a headrest rotatably connected to the second driver, the headrest being rotatably connected to the bracket body.

In an embodiment of the invention, the headrest includes a second crossbar rotatably connected to the second driver, and a headrest rotating sheet fixedly connected to both ends of the second crossbar, the headrest rotating sheet being rotatably connected to the bracket body.

In an embodiment of the invention, a first crossbar is fixedly connected between the bracket body and the fixing base, and the second driver is rotatably connected to the first crossbar.

In an embodiment of the invention, the second driver is an electric push rod.

In an embodiment of the invention, a return spring is connected and disposed between the headrest and the bracket body.

Compared with the prior art, the present invention provides a waist ejecting mechanism and a headrest flipping mechanism, thereby realizing the functions of the waistrest ejecting and adjusting the headrest, so as to facilitate convenience and practicality.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

The present invention will be further elaborated hereafter in connection with the drawings.

Figure 1:
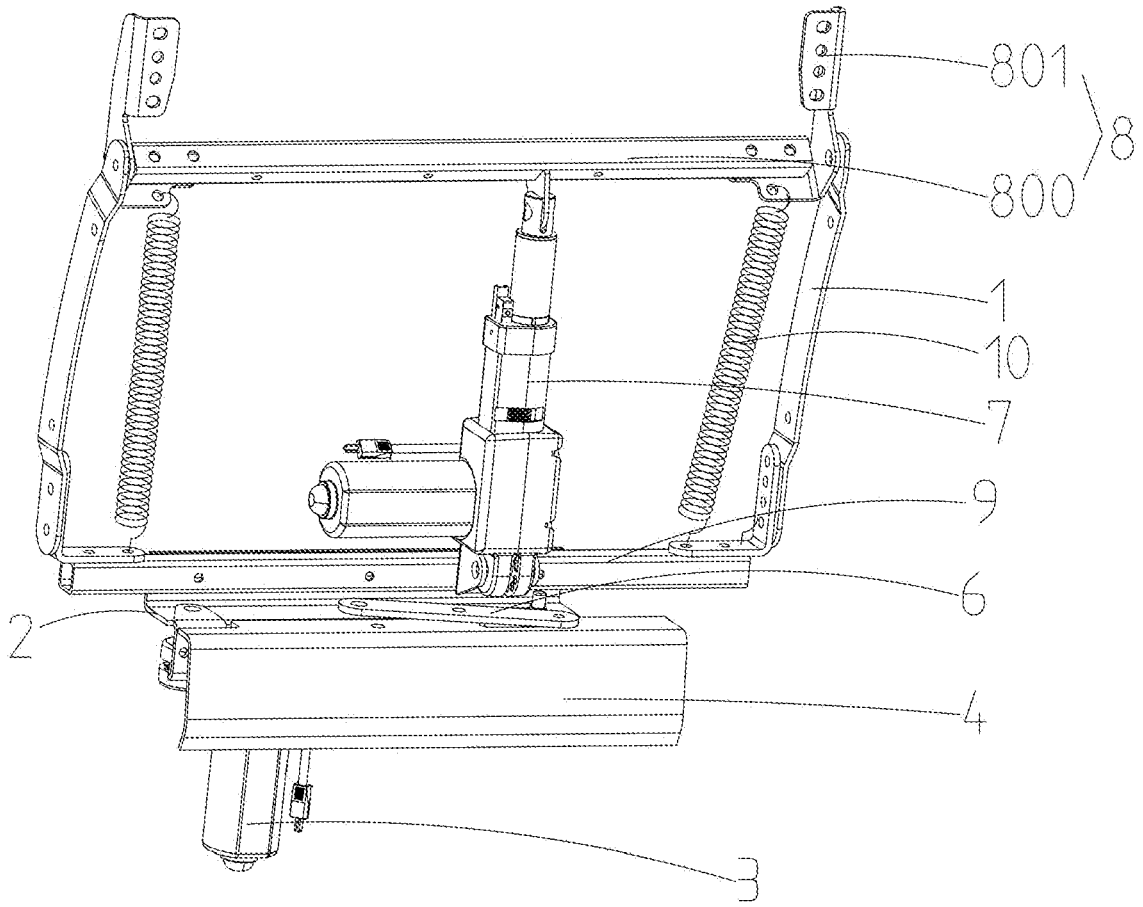
FIG. 1 is a view of a structure of the present invention.
Figure 2:
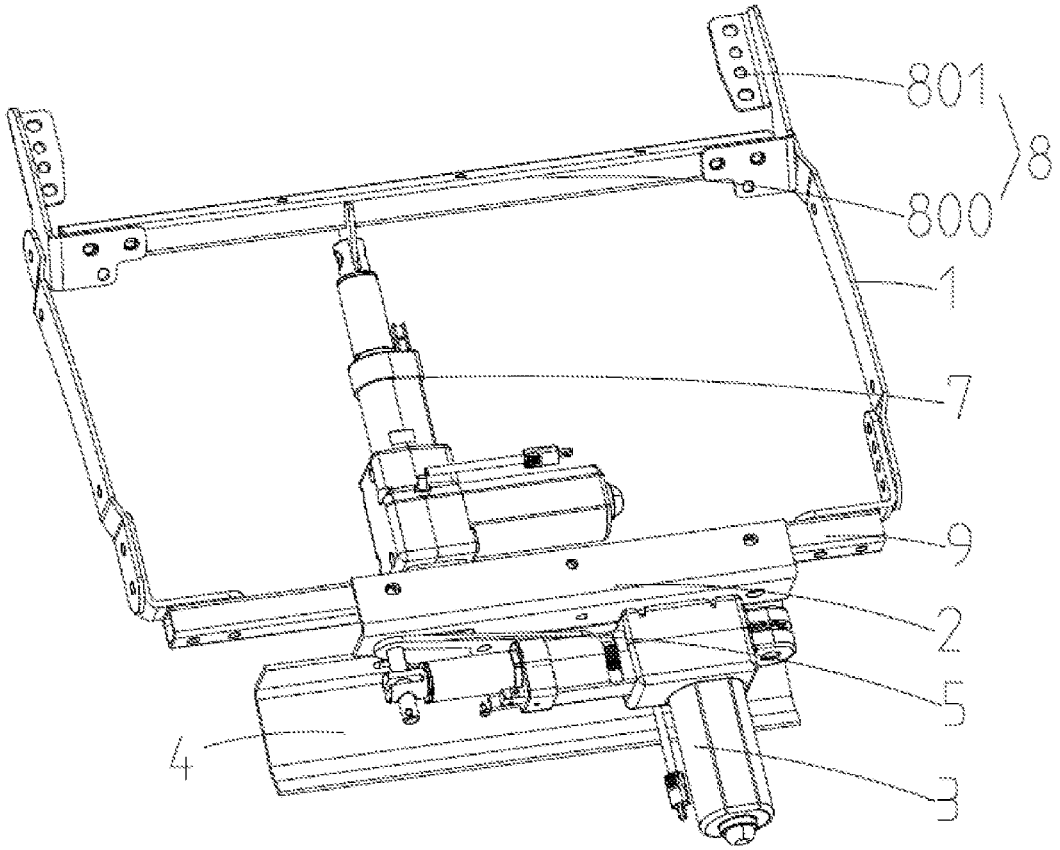
FIG. 2 is a structural view of the present invention in a state in which a return spring is removed.
Figure 3:
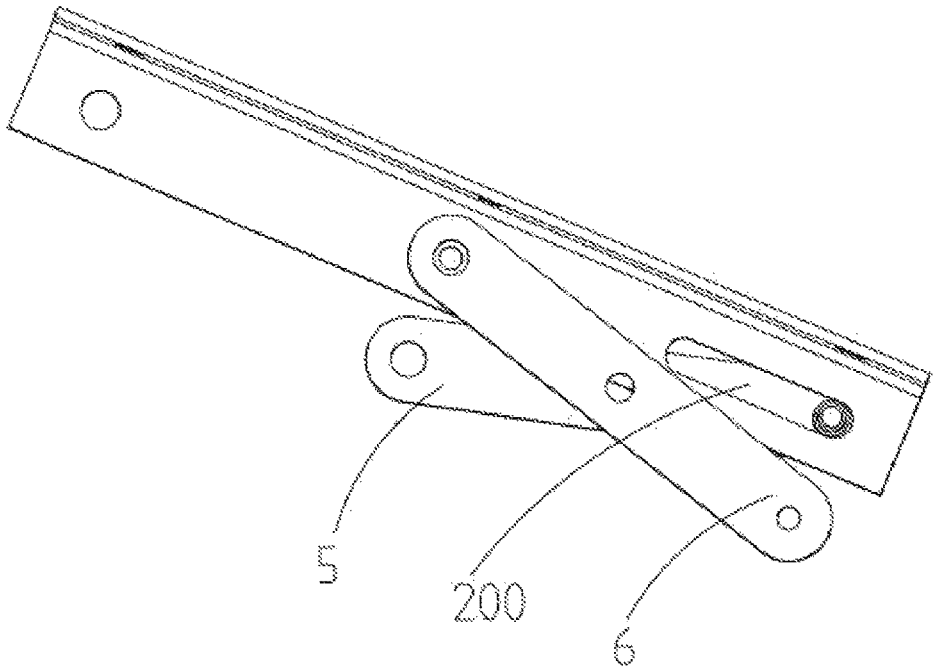
FIG. 3 is a structural view showing cooperation of a folding link assembly and the fixing base in the present invention.

As shown in FIG. 1 to FIG. 3, a head and waist integrated device includes a bracket body 1. The bracket body 1 is provided with a headrest flipping mechanism and a waist ejecting mechanism. The waist ejecting mechanism includes a fixing base 2 fixedly connected to the bracket body 1, a first driver 3 hinged to one end of the fixing base 2, a folding link assembly, and a waist ejecting member 4 hinged to the folding link assembly. Links in the folding link assembly cross and are rotatably connected to each other. Specifically, the folding link assembly includes a first link 5 and a second link 6. One end of the first link 5 is hinged to the first driver 3, and the other end of the first link 5 is hinged to the waist ejecting member 4. One end of the second link 6 is hinged to the fixing base 2, and the other end of the second link 6 is hinged to the waist ejecting member 4. A middle portion of the first link 5 is hinged to a middle portion of the second link 6. A sliding slot 200 is defined in the fixing base 2, and the end of the first link 5 that is hinged to the first driver 3 is slidably connected to the sliding slot 200.

Further, the first driver 3 in the waist ejecting mechanism is an electric push rod, and the waist ejecting member 4 is an L-shaped plate structure.

The headrest flipping mechanism includes a second driver 7 hinged to the bracket body 1, and a headrest 8 hinged to the second driver 7. The headrest 8 being rotatably connected to the bracket body 1. Specifically, the headrest 8 includes a second crossbar 800, and a headrest rotating sheet 801 fixedly connected to both ends of the second crossbar 800. The headrest rotating sheet 801 is hinged to the bracket body 1. A first crossbar 9 is fixedly connected between the bracket body 1 and the fixing base 2. One end of the second driver 7 is hinged to the first crossbar 9, and the other end of the second driver 7 is hinged to the second crossbar 800. The second driver 7 is also an electric push rod.

A return spring 10 is hung on each side of the bracket body 1. When the headrest flipping mechanism is retracted from the open position, for safety, the return spring 10 instead of the second driver 7 provides a pulling force for retracting the headrest.

In operation, in the waist ejecting mechanism, the first driver 3 pushes one end of the first link 5 to slide in the sliding slot 200 to extend the folding link assembly, and then the folding link assembly drives the waist ejecting member 4 to horizontally eject; in the headrest flipping mechanism, the second driver 7 pushes the second crossbar 800 to flip, and the second crossbar 800 drives the headrest rotating sheet 801 to flip, so that the headrest fixed to the second crossbar 800 and the headrest rotating sheet 801 is flipped over.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A head and waist integrated device, comprising a bracket body, wherein the bracket body is provided with a headrest flipping mechanism and a waist ejecting mechanism, and the waist ejecting mechanism includes a fixing base fixedly connected to the bracket body, a first driver rotatably connected to one end of the fixing base, a folding link assembly respectively rotatably connected to the first driver and the fixing base, and a waist ejecting member rotatably connected to the folding link assembly, and the folding link assembly has a plurality of links disposed therein, and the links cross and are rotatably connected to each other, wherein the folding link assembly includes a first link and a second link; the first link has one end rotatably connected to the first driver, and the other end rotatably connected to the waist ejecting member; the second link has one end rotatably connected to the fixing base, and the other end rotatably connected to the waist ejecting member; a middle portion of the first link is rotatably connected to a middle portion of the second link.

2. The head and waist integrated device according to claim 1, wherein a sliding slot is defined in the fixing base, and the end of the first link that is rotatably connected to the first driver is slidably connected to the sliding slot.

3. The head and waist integrated device according to claim 2, wherein the headrest flipping mechanism includes a second driver rotatably connected to the bracket body, and a headrest rotatably connected to the second driver, the headrest being rotatably connected to the bracket body.

4. The head and waist integrated device according to claim 1, wherein the first driver is an electric push rod.

5. The head and waist integrated device according to claim 4, wherein the headrest flipping mechanism includes a second driver rotatably connected to the bracket body, and a headrest rotatably connected to the second driver, the headrest being rotatably connected to the bracket body.

6. The head and waist integrated device according to claim 1, wherein the waist ejecting member is an L-shaped plate structure.

7. The head and waist integrated device according to claim 6, wherein the headrest flipping mechanism includes a second driver rotatably connected to the bracket body, and a headrest rotatably connected to the second driver, the headrest being rotatably connected to the bracket body.

8. The head and waist integrated device according to claim 1, wherein the headrest flipping mechanism includes a second driver rotatably connected to the bracket body, and a headrest rotatably connected to the second driver, the headrest being rotatably connected to the bracket body.

9. The head and waist integrated device according to claim 8, wherein the headrest includes a second crossbar rotatably connected to the second driver, and a headrest rotating sheet fixedly connected to both ends of the second crossbar, the headrest rotating sheet being rotatably connected to the bracket body.

10. The head and waist integrated device according to claim 8, wherein a first crossbar is fixedly connected between the bracket body and the fixing base, and the second driver is rotatably connected to the first crossbar.

11. The head and waist integrated device according to claim 8, wherein the second driver is an electric push rod.

12. The head and waist integrated device according to claim 8, wherein a return spring is connected and disposed between the headrest and the bracket body.

* * * * *